US006626496B2

(12) United States Patent
Beach et al.

(10) Patent No.: US 6,626,496 B2
(45) Date of Patent: Sep. 30, 2003

(54) DENTAL TREATMENT CHAIR ASSEMBLY

(75) Inventors: Daryl Raymond Beach, Suita (JP); Masato Miyahara, Kyoto (JP); Naoki Katsuda, Kyoto (JP)

(73) Assignee: J. Morita Manufacturing Corporation, Kyoto (JP)

( * ) Notice: Subject to any disclaimer, the term of this patent is extended or adjusted under 35 U.S.C. 154(b) by 0 days.

(21) Appl. No.: 09/844,800

(22) Filed: Apr. 27, 2001

(65) Prior Publication Data

US 2002/0017812 A1 Feb. 14, 2002

(51) Int. Cl.[7] ..... A61G 15/00

(52) U.S. Cl. ..... 297/391; 297/217.1; 297/408; 297/188.06

(58) Field of Search ..... 297/217.3, 217.1, 297/188.06, 188.04, 188.2, 188.01, 408, 188.02

(56) References Cited

U.S. PATENT DOCUMENTS 3,817,576 A * 6/1974 Ciavattoni et al. ..... 297/408
RE29,811 E * 10/1978 Norris ..... 297/408
4,209,907 A * 7/1980 Tsukada et al. ..... 433/33
4,413,858 A * 11/1983 Beach ..... 297/188
5,628,546 A * 5/1997 Boetzkes ..... 297/316

* cited by examiner

*Primary Examiner*—Peter M. Cuomo
*Assistant Examiner*—Stephanie Harris
(74) *Attorney, Agent, or Firm*—Koda & Androlia

(57) ABSTRACT

A dental treatment chair assembly with a treatment chair for keeping a patient in sitting position or in supine position, characterized by a treatment chair (bed) having a headrest for holding the head of a patient, and a backrest for holding the back and the waist of the patient, and instrument connection ports detachably connected to a dental treatment instrument which are disposed at the back or the side of said headrest, or at the back or the side of the backrest near by the headrest. In the preferred embodiment, the headrest is inclinably supported by the backrest, and a projecting part turning above is provide for compensating an estrangement between the headrest and the backrest.

3 Claims, 4 Drawing Sheets

DENTAL TREATMENT CHAIR ASSEMBLY

BACKGROUND OF THE INVENTION

1. Field of the Invention

The present invention relates to an improved dental treatment chair assembly with a treatment chair for keeping a patient in sitting position or in supine position.

2. Description of the Prior Art

The applicant of the present invention has proposed a dental treatment chair assembly with a treatment chair (bed) for keeping a patient in sitting position or in supine position as disclosed in JP-A-9-220263 and its basic structure is shown in FIG. 4.

The dental treatment chair assembly is characterized by a treatment chair 21 for holding a patient K in sitting position or in supine position.

The treatment chair 21 as shown in FIG. 4(*a*) comprises a headrest 21*a* for holding the head of a patient K, a backrest 21*b* for holding the back and the waist of the patient K, and a footrest 21*g* for holding the legs of the patient K. The above each part is connected each other so as to form a gentle curve plane. The headrest 21*a* is rotatably connected to the backrest 21*b* by means of a shaft 21*c*, while other parts are designed to maintain flat so as to lie the patient K on his back.

The headrest 21*a* is provided for holding a head of the patient K and the backrest 21*b* for holding a back of the patient K and they are usually formed as such shapes lacking the parts indicated by shaded portions as shown in the figure along with the shape of the object to be held on. However according to the treatment chair 21 so constructed, a projecting part 21*e* is provided in an estrangement (shaded portions) formed between the headrest 21*a* and the backrest 21*b*.

Therefore, according to the above construction, for even such a patient K with long hair, it is surely prevented that his long hair hangs down from the headrest 21*a*.

While the treatment chair 21 is provided with an incline means 21*f* with an incline control means 21*fa* for inclinably holding the headrest 21*a* against the backrest 21*b* as shown in FIG. 4(*b*) and FIG. 4(*c*), according to which, an oral cavity of the patient K can be set in desirable position as well as in its opening condition each corresponding to medical object, and in any conditions, the above projecting part 21*e* had been designed to prevent the long hair of the patient from hanging down.

The above projecting part is applied to such treatment chair capable of keeping a patient sitting or semi-supine position that the backrest is correspondingly divided into a back part and a waist part, and each corresponding part of the back part and the waist part is designed inclinable, further the footrest is also inclinable against the waist part of the backrest.

In a related art on dental treatment chair assemblies with treatment chairs, in addition to the above projecting portion, such as a dental hand piece with tubes is provided for facilitating operator's usage at the side of a shoulder part of the backrest 21*b* which holds a shoulder of the patient K so that it can be pulled in and out on use. However, in the above structure, its structure would become complicated due to incorporation of a mechanism for pulling in and out tubes into the backrest 21*b*.

In JP-A-59-139256, another related art is also disclosed wherein a dental treatment instrument with tubes is connected to connection ports provided around a part where a patient's hand is positioned at a lower side of a seat of a dental treatment chair. However according to such related art, as the connection ports are provided apart from an object, namely the oral cavity of the patient, tubes of the instrument would become longer and cause difficulty in their handling.

SUMMARY OF THE INVENTION

The present invention has been proposed considering the above-mentioned problems.

Accordingly it is an object of the invention is to provide a dental treatment chair assembly in which spaces of the back or the side of the headrest as well as spaces of their around, which are closest to the oral cavity of a patient, are effectively utilized and kinds of treatment instruments capable of more convenient using for an operator can be increased without striking terror into a patient's heart due to not using a complicated mechanism for pulling in or out the tubes.

In order to achieve the above object, the present invention is provide a dental treatment chair assembly with a treatment chair (bed) for keeping a patient in sitting position or in supine position, comprising; a treatment chair having a headrest for holding the head of a patient and a backrest for holding the back and the waist of said patient, and instrument connection ports detachably connected to a dental treatment instrument, said ports being disposed at the back or the side of said headrest, or at the back or the side of said backrest near by said headrest.

According to the dental treatment chair assembly of the present invention, estrangement or spaces which haven't been conventionally utilized are effectively utilized.

Also, according to the present invention, since an extra instruments connection ports to which instruments are connected, are provided at the nearest position to the oral cavity of a patient, where the patient can't see, the operator can connect the necessary instrument to the above extra instruments connection ports and give the patient necessary medical treatment without giving any terror into his heart under the circumstances easy for handling it and with a little stress on use and further an additional advantage that the length of tube provided in the treatment chair assembly can be made shorten is provided.

Further according to the present invention, a projecting part turning above which is formed so as to compensate an estrangement or a space between the headrest and the backrest functions a border partition between a space to receive treatment on a patient side and a space to give treatment on a doctor in addition by which the hair of a patient who is under the medical treatment on the treatment chair can be effectively prevented from hanging down from the treatment chair.

DETAILED DESCRIPTION OF THE INVENTION

Embodiments of the present invention will be given referring to the attached drawings.

Figure 1:
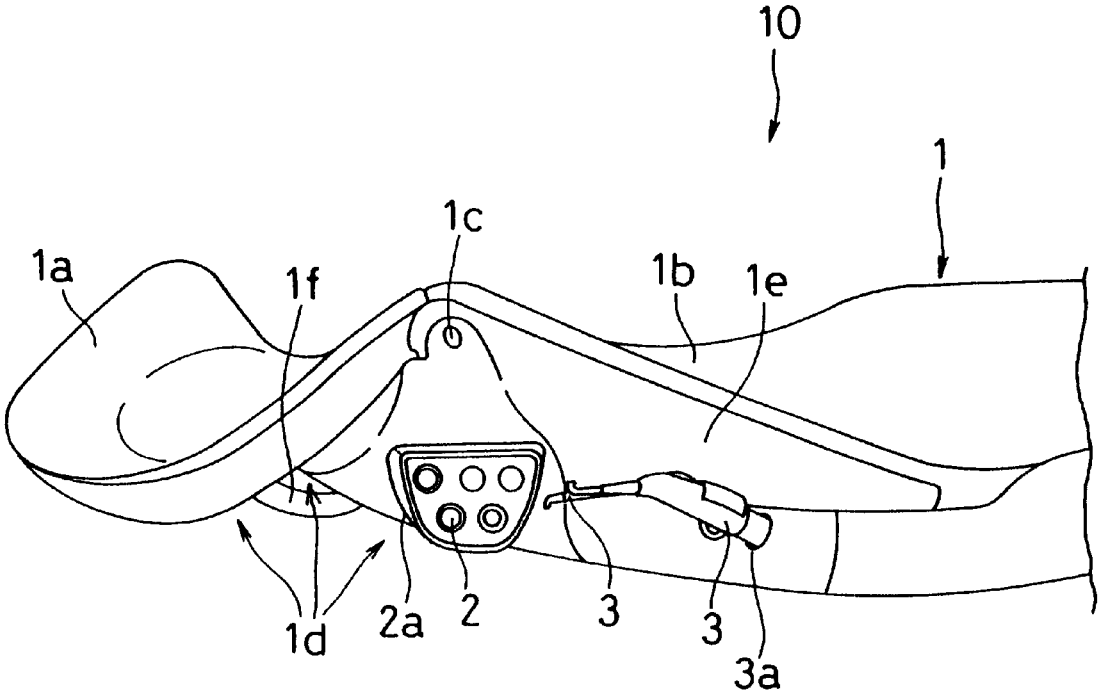
FIG. 1 is an oblique perspective view of a substantial part of one embodiment of a dental treatment chair assembly of the present invention when seen from an operator.

FIG. 1 is a substantial part of one embodiment of a dental treatment chair assembly of the present invention when seen from an operator.

Figure 4A:
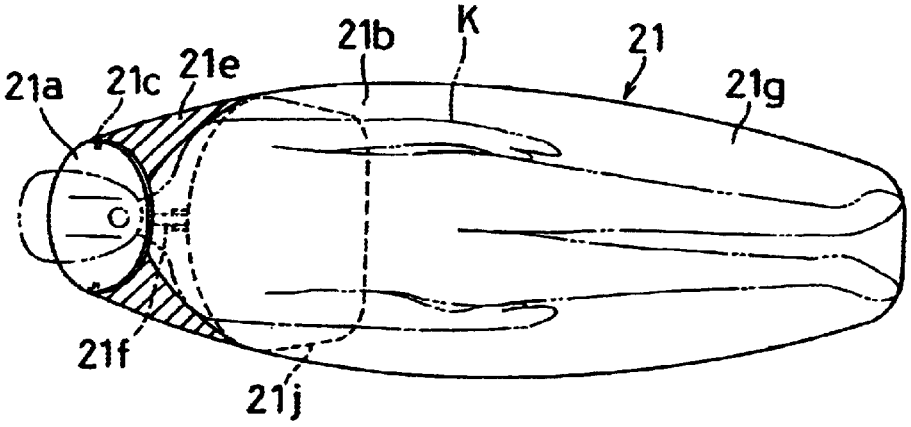
Fig.4(a) Prior Art
FIG. 4 shows one embodiment of prior dental treatment chair assembly, wherein FIG. 4(*a*) shows its plane view, and FIG. 4(*b*) and FIG. 4(*c*) show its enlarged sectional view.
Figure 4B:
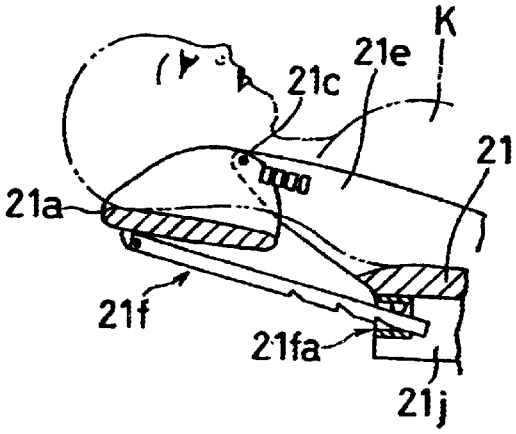
Fig.4(b) Prior Art
Figure 4C:
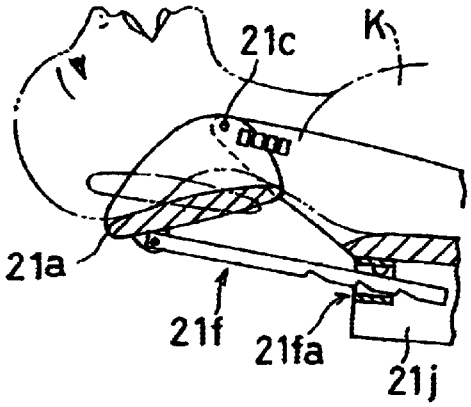
Fig.4(c) Prior Art

The dental treatment chair assembly 10 is provided with a treatment chair (bed) 1 comprising, a headrest 1*a*, a backrest 1*b*, a shaft 1*c* for inclinably supporting the headrest 1*a* against the backrest 1*b*, a projecting part 1*e*, and an incline means if of the headrest 1*a* and so on. Their constructions are the same as a headrest 21*a*, a backrest 21*b*, a shaft 21*c*, a projecting part 21*e*, and an incline means 21*f* of the prior art in FIG. 4.

An instrument holding means 3*a* capable of pulling in and out an instrument 3 having tubes is provided for a part corresponding to a shoulder part of the back of the backrest 1*b* like the prior art.

The characteristic of the treatment chair 1 is in that instrument connection port 2 capable of connecting the dental treatment instruments detachably is provided at the back or the side of the headrest 1*a* or neighborhood id thereof. The connection port 2 may be one or five like a figure in necessary.

In this embodiment a connection port setting member 2*a* is provided by unifying five connection ports 2, however, it isn't required to be unified.

As the instrument connection port 2 is provided where a patient can't see and which is nearest from the oral cavity of the patient, an operator can practice without giving scare to the patient and without having stress on usage by connecting required treatment instruments to the connection port 2. Further, the tubes of the treatment instruments can be made shorter.

Especially in this case, the patient's space and the operator's space can be clearly divided because of the projecting part 1*e*. The projecting part 1*e* can prevent the patient's hair from hanging so that it can prevent incoming of object from the patient's space to the operator's space. The patient can be examined at ease because examination isn't disturbed by his own hair and so on. On the other hand, the operator can concentrate on medical care without contaminating the instruments and without being disturbed by the patient's hair and so on.

The projecting part 1*e* is for emphasizing the barrier between the patient and the operator and for playing various roles. The basic characteristic of the present invention is providing an instrument connection port at the back and side of the backrest and neighborhood thereof. From this point of view, the projecting part 1*e* isn't an essential member. The projecting part 1*e* is formed as one part of the backrest 1*b*, however, it may be provided for the headrest 1*a*.

Figure 2:
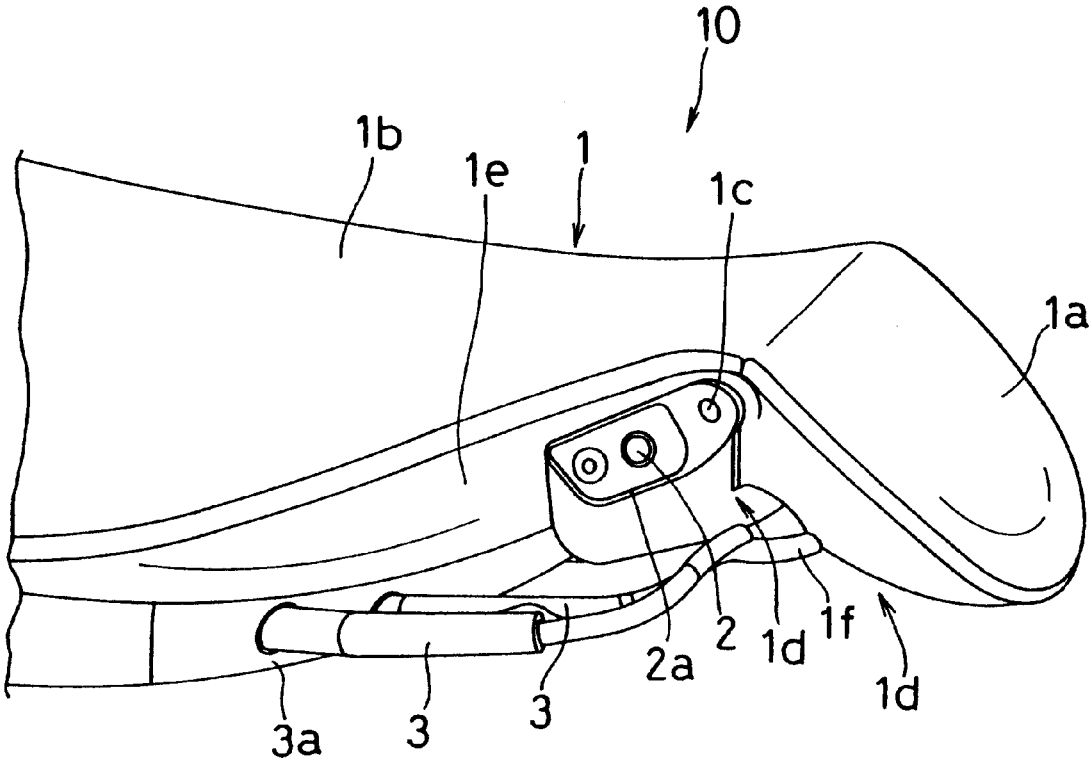
FIG. 2 is an oblique perspective view of a substantial part of FIG. 1 when seen from an assistant.

FIG. 2 is a substantial part of FIG. 1 from opposite direction, namely seen from an assistant. The same member is given the same reference numeral and their explanations are omitted.

In the figure, the instrument connection port 2 and the connection port setting member 2*a* unifying the connection ports 2 are provided for an assistant side, namely at opposite interposing the headrest 1*a*, which is also at the back or side of the headrest 1*a* and its neighborhood 1*d*.

Also in this case the same effect can be achieved, and further it is convenient for the assistant to use necessary dental instruments.

Figure 3:
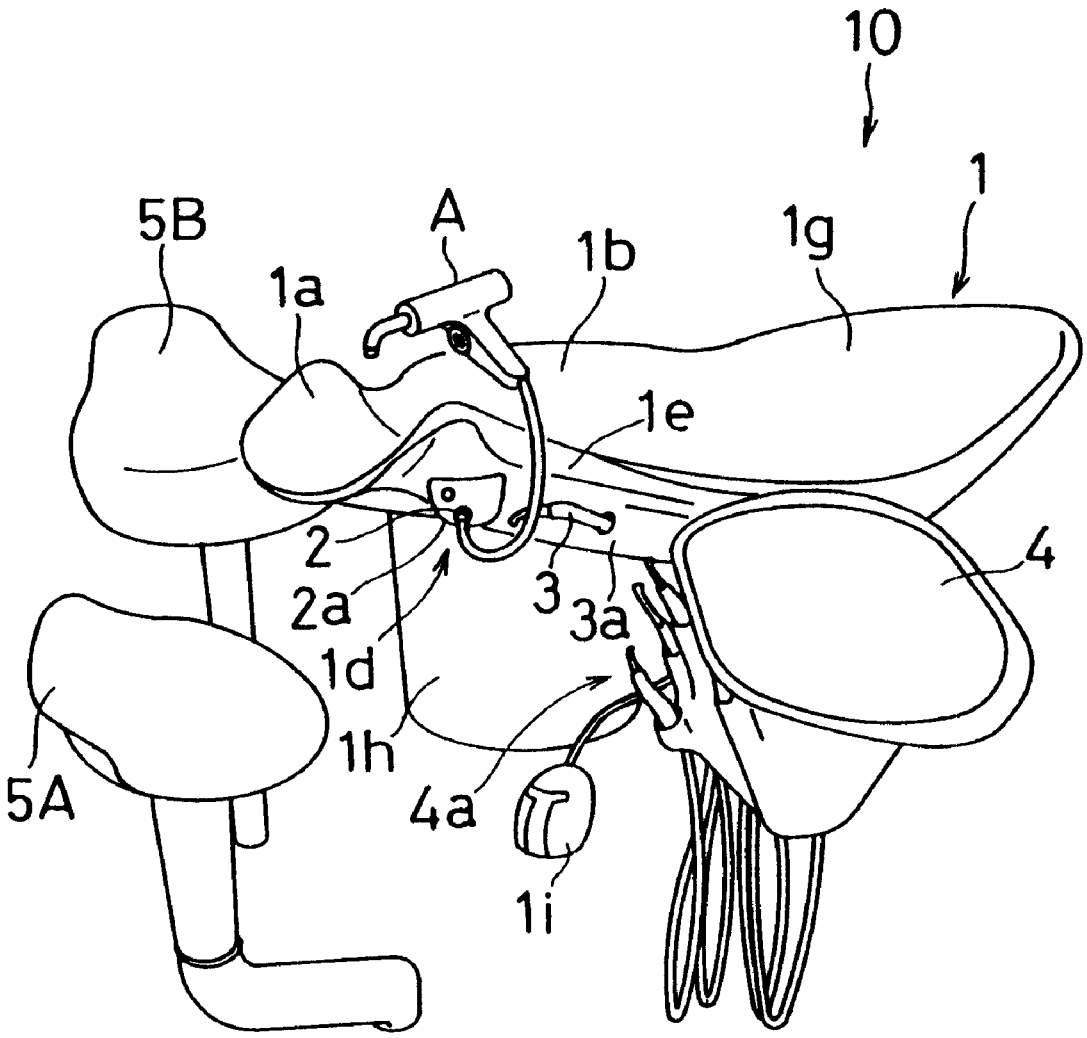
FIG. 3 is an entire oblique perspective view of one embodiment showing usage of a dental treatment chair assembly of the present invention.

FIG. 3 is an entire oblique perspective view of one embodiment showing usage of a dental treatment chair assembly of the present invention.

In FIG. 3 other members constructing the dental treatment chair assembly 10 are shown.

A footrest 1*g* is provided for the treatment chair 1. Further a pedestal 1*h* for vertically movable and rotatably supporting the treatment chair 1 and a foot controller 1*i* for controlling operation of the dental treatment instrument 3 and so on are shown in the figure.

A tray table 4 is provided slidably along the right side of the backrest 1*b* of the treatment chair 1, namely at the operator's side. A dental treatment instrument 4*a* which is often used is held so as to be able to pull in and out together with its tube at the operator's side of the tray table 4.

An operator's chair 5A is provided slidably so as to describe an arc from the head side to the right shoulder side of the headrest 1*a* of the treatment chair 1, namely into operator's side. An assistant's chair 5B is provided facing the operator's chair 5A interposing the treatment chair 1.

In this embodiment, a dental treatment instrument A, here a light polymerization means A, is connected with the instrument connection port 2 at the operator's side and the light polymerization means A is used in the oral cavity of the patient. The patient, the operator, and the assistant aren't shown in order to avoid vexatious complication.

As the instrument connection port 2 is provided at the back and side of the headrest 1*a* and its neighborhood 1*d*, which are nearest position to the oral cavity of the patient, short tube of the light polymerization means A can be used and the operator can practice easily without having stress.

The neighborhood id may be around the headrest 1*a* at the back or side of the backrest 1*b* or may be at the back of the projecting part 1*e*.

As the operator can use the instrument A connected to the instrument connection port 2 other than the instrument 2 around the shoulder of the back of the backrest 1*b* and the instrument 4*a* held at the tray table 4 while sitting in the operator's chair 5A, the kinds and number of the usable instruments are increased so that extensive care can be executed.

Further, the instrument connection port 2 can be made a multi connection which can connect any necessary dental treatment instruments. In such a case if the number of the connection port 2 capable of providing at the back or side of the headrest 1*a* or at its neighborhood 1*d* is limited, instruments more than the number of the ports can be used so that extensive care can be executed.

Instruments connected to the instrument connection port 2 are a light polymerization means, a root canal measuring means, and soon. However, an air turbine hand piece or a micro motor hand piece may be connected. Further, such instruments may have holders which aren't shown in the tray table 4.

Moreover, the dental treatment instruments may not be provided with tubes. They may be instruments which incorporate rechargeable battery, are charged by connecting to the connection port, and can be used without tubes. In this case as the instrument connection port is provided at the nearest position to the oral cavity of the patient, instruments can be easily handled.

What is claimed is:

1. A dental treatment chair assembly with a treatment chair for keeping a patient in sitting position or in supine position, comprising:

a treatment chair having a headrest for holding the head of a patient and a backrest for holding the back and the waist of said patient, an upwardly turned projecting part is provided so as to compensate an estrangement between said headrest and said backrest, and an instrument connection port disposed under said protecting part to which a dental treatment instrument is connected, said instrument connection port for supplying operating medium for the instrument connected thereto, said operating medium being selectable from the group consisting of air, water and electricity.

2. The dental treatment chair assembly as set forth in claim 1, wherein said headrest is inclinably supported by said backrest.

3. A dental treatment chair assembly with a treatment chair for keeping a patient comprising:

a treatment chair having a headrest for holding the head of a patient and a backrest for holding the back and to waist of said patient, an upwardly turned projecting part provided for compensating an estrangement between said headrest and said backrest; and an instrument connection port disposed under said projecting part, to which a dental treatment instrument is connected, said instrument connection port for supplying operating medium to said instrument to be connected thereto, and said operating medium being selectable from the group consisting of air, water and electricity.

* * * * *

UNITED STATES PATENT AND TRADEMARK OFFICE

CERTIFICATE OF CORRECTION

PATENT NO. : 6,626,496 B2
DATED : September 30, 2003
INVENTOR(S) : Daryl Raymond Beach et al.

It is certified that error appears in the above-identified patent and that said Letters Patent is hereby corrected as shown below:

Title page,
Item [30], Foreign Application Priority Data, add
-- May 1, 2000 (JP) …… 2000-132300 --

Signed and Sealed this

Twenty-sixth Day of July, 2005

JON W. DUDAS
*Director of the United States Patent and Trademark Office*